US005256038A

United States Patent [19]

Fairman

[11] Patent Number: 5,256,038

[45] Date of Patent: Oct. 26, 1993

[54] CANNED MOTOR PUMP

[75] Inventor: Kevin Fairman, Evergreen, Colo.

[73] Assignee: Sundstrand Corp., Rockford, Ill.

[21] Appl. No.: 791,575

[22] Filed: Nov. 12, 1991

[51] Int. Cl.[5] ..... F04B 17/00; F04B 35/04

[52] U.S. Cl. ..... 417/423.11; 417/423.14

[58] Field of Search ..... 417/423.7, 423.8, 423.11, 417/423.14; 415/171.1

[56] References Cited

U.S. PATENT DOCUMENTS

| | | | |
|---|---|---|---|
| 2,448,717 | 9/1948 | Jeffcock . | |
| 3,090,546 | 5/1963 | Woollenweber, Jr. . | |
| 3,180,568 | 4/1965 | Oettle . | |
| 3,318,253 | 5/1967 | Campolong . | |
| 3,395,645 | 8/1968 | Vilet . | |
| 3,544,116 | 12/1970 | Peterson | 277/3 |
| 4,521,151 | 6/1985 | Frater et al. | 415/171.1 |
| 4,621,981 | 11/1986 | Lorett | 417/83 |
| 4,990,055 | 2/1991 | Korenblit | 415/171.1 |

*Primary Examiner*—Richard A. Bertsch

*Assistant Examiner*—Alfred Basichas

*Attorney, Agent, or Firm*—Wood, Phillips, VanSanten, Hoffman & Ertel

[57] ABSTRACT

In order to restrict flow between the motor and pump of canned motor pump, a seal arrangement is provided for use with a canned motor pump which has a motor disposed within a motor housing and an axially extending output shaft for rotating an auxiliary impeller to circulate fluid from an external supply to cool and lubricate the motor. A pump housing is abutted with the motor housing and surrounds a main impeller which is seated on the motor shaft. A seal assembly is provided to minimize the leakage between the pump housing and the motor housing and includes a pair of axially spaced bushing seals which surround the motor output shaft and define an annular reference cavity between the seals. A passageway connects the pump outlet and the reference cavity to permit the motor fluid to reference pump discharge pressure without subjecting the impeller to increased axial thrust.

7 Claims, 2 Drawing Sheets

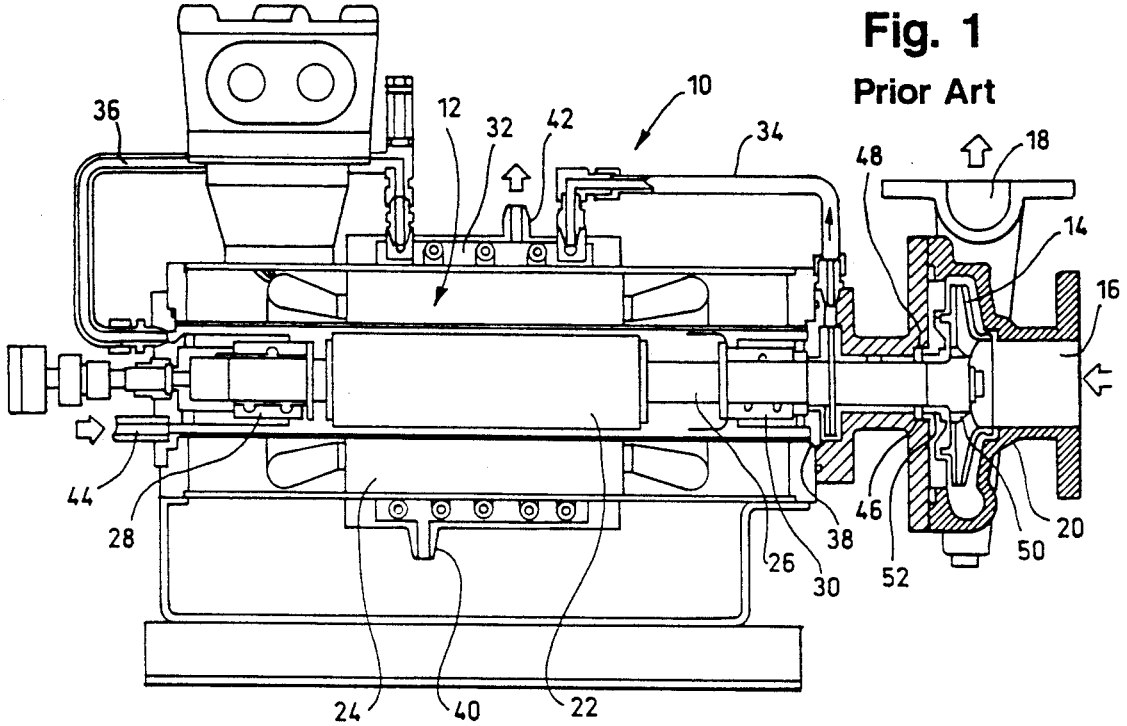
Fig. 1
Prior Art
Fig. 4
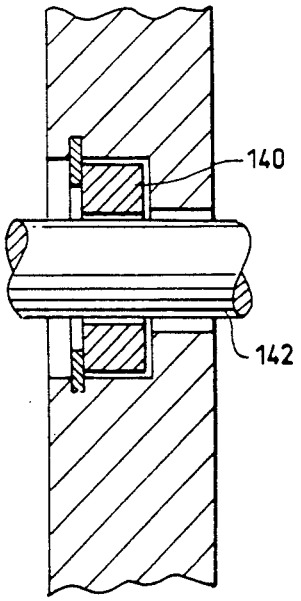
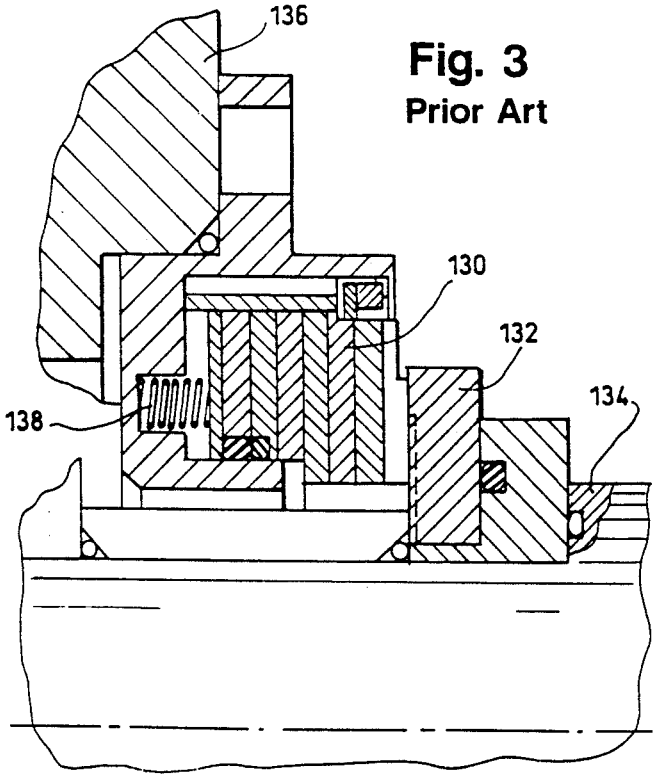
Fig. 3
Prior Art

CANNED MOTOR PUMP

FIELD OF THE INVENTION

This invention relates to a canned motor pump in which an external supply of cooling and lubricating fluid is circulated through the motor. More specifically, the invention resides in an internal seal arrangement in a canned motor pump for restricting flow between the motor and the pump.

BACKGROUND OF THE INVENTION

Canned motor pumps use the pressure differential created by the pump impeller to drive fluid through the motor to lubricate the motor bearings as well as remove heat which is generated due to the inefficiency of the motor. In order to increase the useful life of the motor bearings and minimize erosion of the motor components which contact the cooling and lubricating fluid, it is preferable that the fluid be free of abrasives. Thus, the corrosive properties of the fluid, the fluid viscosity, and the vapor pressure characteristics of the fluid each must be considered when assessing the suitability of a fluid as a bearing lubricant and heat transfer medium.

In many applications, the fluid to be displaced by the pump is an abrasive slurry which is unsuitable for service in the motor. Accordingly, a clean, process compatible fluid is flushed through the motor from an external source. Clean fluid is flushed through the motor at a pressure determined by the input flow rate. Additionally, an auxiliary circulating impeller is seated on the motor shaft to facilitate the circulation of clean fluid through the motor housing.

An internal seal is provided between the motor and the pump to prevent the pumped slurry from entering the motor housing and contacting the motor components. Preferably, the externally supplied fluid pressure is greater than the pressure of the slurry immediately upstream of the seal, so that clean motor fluid at high pressure leaks across the seal and into the pump housing. The restriction provided by the internal seal accelerates the leakage flow to oppose backflow of the slurry into the motor. The motor fluid which leaks into the pump housing, sometimes called barrier fluid, is dispelled by the pump impeller and discharged through the pump outlet.

One problem which exists with the above construction is that the clean fluid which is flushed through the motor and leaks across the internal seal must be distilled from the mixture which is discharged from the pump. Distillation of the motor fluid and the slurry is an expensive, time consuming process which can greatly limit the usefulness of the canned motor pump.

Another problem is that because leakage through the internal seal is directly proportional to the pressure differential across the seal, in applications where the pump-side pressure is relatively low, minimum leakage requirements and the necessary small pressure differential across the seal limit the pressure which can be maintained in the motor.

The maintenance of high fluid pressure in the motor is desired because when a volatile fluid is used to cool and lubricate the motor, temperature rises in the motor can cause the fluid to vaporize and cause extensive motor damage via cavitation effects or by blocking the flow. It therefore is desirable to maintain the motor fluid at a pressure which is greater than the fluid's vapor pressure to maintain the fluid in the liquid phase. However, fluid pressure in the motor housing is equal to the pump-side reference pressure at the seal plus the pressure differential across the seal. The capability of maintaining a high motor pressure therefore requires either (a) a large pressure differential across the seal, or (b) an increased pump-side reference pressure of the slurry.

For instance, if the slurry pressure at the pump-side of the seal is 10 psi, in order to minimize the leakage through the seal, it is necessary to maintain a relatively low differential pressure across the seal and hold the fluid pressure in the motor housing at approximately 12 psi. However, when the vapor pressure of the externally supplied fluid in the motor housing is 20 psi, the fluid pressure in the motor housing must be increased above 20 psi to reduce the risk of motor fluid vaporization.

A relatively high motor pressure could be accommodated together with a low pump reference pressure by increasing the pressure differential across the seal As discussed above, however, an increased pressure differential causes increased leakage through the seal and results in the necessity of distilling motor fluid from the particular slurry which is pumped.

Alternatively, increased motor pressure could be provided together with a pressure differential which meets minimum leakage requirements by increasing the pump-side pressure of the slurry. For instance, if the slurry pressure on the pump-side of the seal was 19 psi, the motor pressure could be raised above the motor fluid vapor pressure and a low pressure differential could be maintained across the seal. Pump-side reference pressure is increased by shrouding the pump impeller or by adding vanes to fixed structure adjacent the impeller. The problem with this solution is that increasing the reference pressure in the pump housing increases the thrust force acting against the backside of the impeller, which degrades axial impeller balance and shortens the service life of the impeller thrust bearings.

The foregoing presupposes that leakage across the internal seal is unavoidable. Although present axial face seals are capable of essentially preventing any leakage, such seals provide limited utility in canned motor pump applications. In certain applications, canned motor pumps use a liberal axial float design in which the motor shaft preferably is free to move axially in order to accommodate manufacturing tolerances and axial wear of the thrust bearings. Because axial face seals are dependent upon precise axial positioning of the shaft they inherently restrict the versatility of an axial float design. In addition, face seals generally require precisely machined faces to maintain a sufficiently flat surface for achieving proper sealing engagement and an associated mechanism for continuously biasing the flat surface into sealing engagement as the surface wears. As a result, face seals are complex and expensive devices which detrimentally impact the performance and cost of a canned motor pump.

Conventional radial bushing seals require tight radial clearances but which are not dependent upon precise axial positioning of the shaft. Radial bushing seals also are less expensive and mechanically simpler than axial face seals. Unfortunately, present canned motor pumps are unable to take full advantage of the benefits of radial bushing seals.

Although radial bushing seals accommodate an axial float design and are more easily and inexpensively manufactured than face seals, radial bushing seals do not provide as complete a seal as face seals and may not satisfy minimum leakage requirements at the differential pressures required. Because the leakage flow rate across the bushing seal is a function of the differential pressure across the seal, it is preferable to hold a low differential pressure across the seal to maintain a minimum seal flow rate. For the reasons discussed above, this characteristic is a problem when the motor pressure required to hold a minimum seal flow rate is lower than the vapor pressure of the fluid.

SUMMARY OF THE INVENTION

It is an object of this invention to provide a canned motor pump having a radial bushing seal arrangement which reduces leakage of an externally supplied motor cooling and lubricating fluid into the pump cavity without increasing impeller thrust in the pump.

In accordance with this invention, a canned motor pump has a motor housing connected to a supply of volatile fluid. A motor is disposed within the motor housing and has an axially extending output shaft for rotating an auxiliary impeller to circulate fluid from the supply through the housing and cool and lubricate the motor and its associated mountings. A pump housing is abutted with the motor housing and has an interior chamber into which the motor output shaft extends. The housing encloses a main impeller which is seated on the motor shaft and is operable to pump fluid between a pump inlet and a pump outlet defined in the pump housing. The impeller has a number of radially extending angularly spaced blades projecting axially from an impeller hub near the pump inlet to impeller blade tips disposed near the pump outlet.

A pair of axially spaced radial bushing seals surround the motor output shaft and define an annular reference cavity between the seals into which a quantity of fluid from the motor housing will flow. A passageway connects the discharge chamber of the pump with the reference cavity to permit fluid in the motor housing to pressure reference the pump discharge pressure and minimize leakage of motor fluid into the reference cavity without increasing thrust on the backside of the impeller.

DESCRIPTION OF THE DRAWINGS

FIG. 1 is a diagrammatic illustration of a prior art canned motor pump having a liner ring for restricting the flow of motor fluid into the pump;

FIG. 3 is a sectional view of an exemplary prior art axial face seal; and

FIG. 4 is a sectional view of an exemplary prior art radial bushing seal.

DESCRIPTION OF THE PRIOR ART

Figure 2:
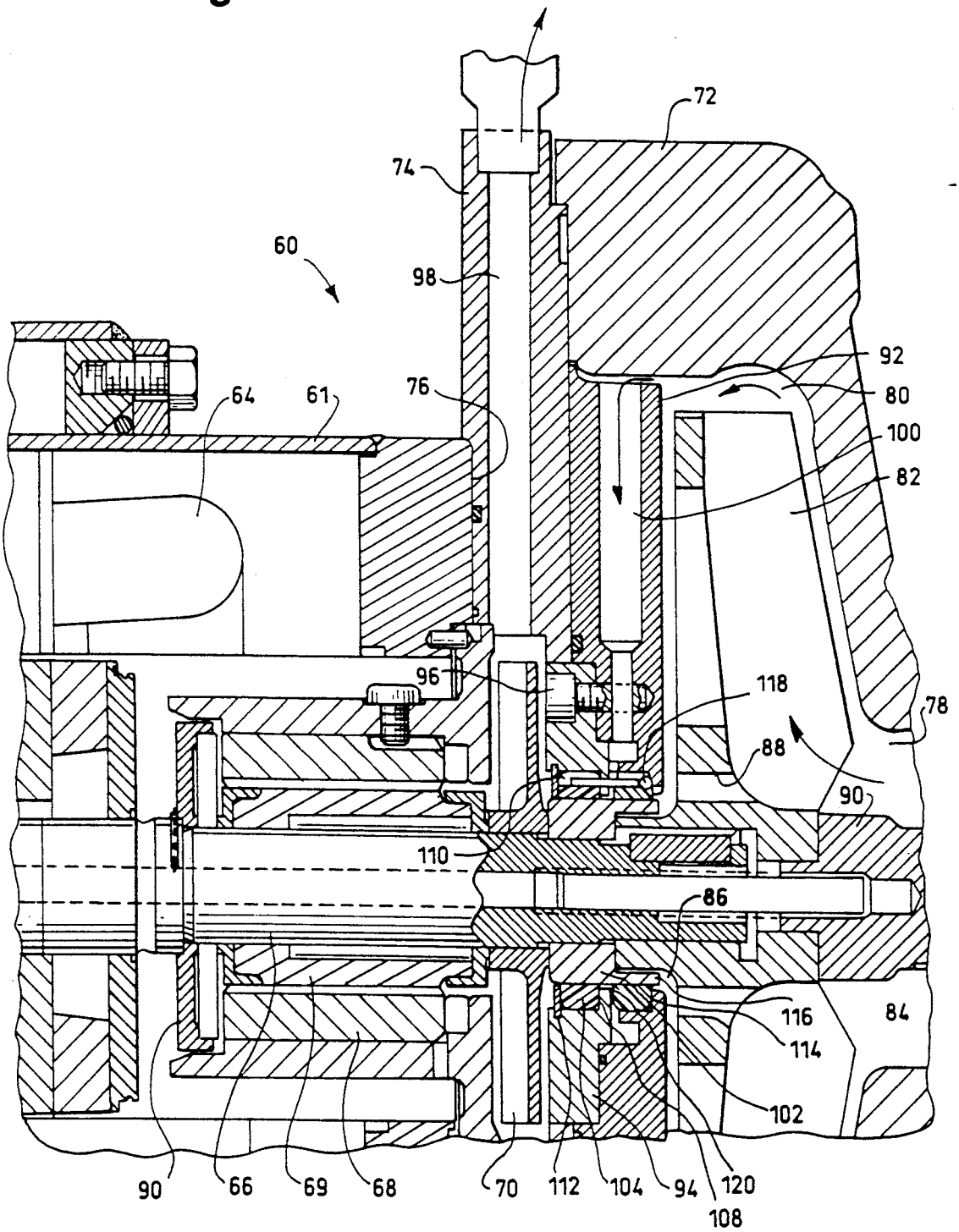
FIG. 2 is a fragmented sectional view of a canned motor pump incorporating the features of the present invention.

FIG. 1 shows a prior art canned motor pump, generally designated 10, having an electric motor drive 12 for rotating an impeller 14 to pump a fluid between a pump inlet 16 and a pump outlet 18 defined in a pump housing 20.

Electric motor drive 12 has an annular rotor 22 enclosed within a fixed cylindrical stator 24 and rotatably supported on an axially extending motor shaft 26. Motor shaft 26 is journaled at opposite ends by bearings 28 and 30 and extends into the interior of the pump housing 20 to support the pump impeller 14 for rotation in the housing.

A liquid-filled heat exchanger 32 is positioned in conductive relation with the stator 24 and is connected to the interior of the stator by conduits 34 and 36. Particularly, conduit 34 defines a passage which extends between motor bearing 30 and one end of the heat exchanger 32, and conduit 36 defines a passageway which extends between an opposite end of the heat exchanger 32 and the motor bearing 28. An auxiliary impeller 38 is mounted on the motor shaft 26 and is effective to circulate the bulk of the motor fluid through the conduits 34 and 36 and across the rotor 22 to transfer heat away from the motor. Cold water is circulated through the heat exchanger 32 by means of an inlet port 40 and an outlet port 42.

In order to flush contaminants from the closed-loop motor circulation path, an external flow is introduced into the motor through a passage 44. Externally supplied fluid passes through the motor, from left to right as shown in FIG. 1, and is drawn across the motor components and discharged through pump outlet 18 by means of the pressure differential created by the pump impeller 14.

Because of the abrasive content of the slurries commonly displaced by a canned motor pump, it is desirable to prevent the backflow of the slurry into the motor interior where the abrasives may shorten bearing life and accelerate the erosion of all motor parts which come into contact with the slurry. Accordingly, a liner ring 46 is seated in a recess 48 formed between the pump and motor to prevent leakage of the slurry into the motor.

The impeller 14 has a number of circumferentially spaced axial openings 50 formed in the impeller hub to communicate fluid pressure at the pump inlet 16 to a reference cavity 52 formed on the backside of the impeller 14 and adjacent the liner ring 46. External motor fluid is supplied through passage 44 to auxiliary impeller 38 at a pressure greater than the pump inlet pressure, and thus greater than the reference pressure, such that leakage across the liner ring 46 is in a left to right direction, as shown in FIG. 1. The restriction imposed by the liner ring causes acceleration of the external motor fluid into the pump, such that the high velocity flow opposes backflow of the abrasive slurry into the motor.

When external motor fluid moves across the liner ring 46, the pressure differential induced by rotation of the pump impeller 14 causes the motor fluid to be discharged through the pump outlet 18, along with the abrasive slurry. As a result, the desired slurry must be distilled from the mixture which is discharged from the pump. Distillation of the motor fluid and slurry mixture is an expensive, time consuming process which can greatly limit the usefulness of a canned motor pump.

In addition, as noted earlier, because leakage flow across the liner ring 46 is proportional to the pressure differential across the liner ring, it is impossible in many applications (such as when pressure in the reference cavity 52 is relatively low) to maintain a fluid pressure in the motor which is greater than the vapor pressure of the motor fluid without causing excessive leakage into the pump.

DETAILED DESCRIPTION OF THE INVENTION

FIG. 2 illustrates a canned motor pump 60 in accordance with the present invention and corresponds generally to the right hand portion of the canned motor pump 10 shown in FIG. 1. Canned motor pump 60 includes a housing 61, a motor drive having a rotor 62 supported within a fixed cylindrical stator 64 and mounted on an axial shaft 66 which is supported at the end shown in FIG. 2 by a bearing 68 engaging a journal sleeve 69 fixed on shaft 66. The bearing support for the shaft is shown and described in more detail in application Ser. No. 703,760 of William J. Mabe filed May 21, 1991 and assigned to the assignee of this application. An auxiliary impeller 70 is mounted on the motor shaft 66 and is operable to circulate a cooling and lubricating flow through the motor and across bearing 68.

A pump housing 72 is secured to the motor by an adaptor plate 74 which is mounted directly to an axial end 76 of the motor. Pump housing 72 defines a pump inlet 78 and a pump outlet 80 and houses an impeller 82 which is driven by an axial end 84 of the motor shaft 66. A thrust balance chamber 86 at the backside of impeller 82 communicates with the pump inlet 78 by a number of axial passages 88. Fluid at substantially inlet pressure flows through the passages 88 in the impeller to equalize the fluid pressure on opposite sides thereof and reduce the axial thrust load on thrust collar 90.

An annular liner disk 92 is mounted adjacent to adapter plate 74, and is bolted to a seal housing 94 by a number of circumferentially spaced bolts 96. A radial passage 98 extends through the adapter plate 74 for discharging cool lubricating motor fluid, and a radial passage 100 extends through liner disk 92 for reasons to be described hereafter.

A cylindrical sleeve 102 is mounted on the motor shaft 66 and is captured axially between the auxiliary impeller 70 and the pump impeller 82. An inner radial bushing seal 104 is positioned between the sleeve 102 and the seal housing 94 and is axially positioned between a shoulder 108 formed on the pump-side of the seal 104, and a retaining ring 110 seated in a groove 112 formed in housing 94 on the motor-side of the seal 104. An outer radial bushing seal 114 is axially spaced from the inner bushing seal 104 and is positioned between the liner disk 92 and the sleeve 102. Bushing seal 114 is axially constrained by a radial shoulder 116 formed inside liner disk 92 on the pump-side of the seal 114. An anti-rotation pin 118 extends axially through the radial shoulder 108 in the seal housing 94 and engages inner seal 104 and outer seal 114 to prevent rotation of the seals relative to the fixed seal housing.

An annular reference cavity 120 is formed between the inner seal 104 and the outer seal 114 and is substantially isolated from the balance chamber 86. Radial passage 100 connects the pump outlet 80 with the reference cavity 120 and thus defines a pressurization port whereby pumped fluid, or slurry, at discharge pressure is directed into the reference cavity 120. Because pump inlet pressure exists in the balance chamber 86, a differential pressure equivalent to the differential created by rotation of the impeller exists across outer seal 114.

As described above, externally supplied motor cooling and lubricating fluid is circulated through the motor by auxiliary impeller 70 and discharged through the axial passage 98. Additionally, the pressure differential between the inlet supply pressure of the external fluid at the impeller 70 and the pump inlet pressure which exists in the pump balance chamber 86 tends to draw the motor fluid across the interposed seal 104, 114. By supplying pump discharge pressure into the annular cavity 120, the pressure differential across inner seal 104 is reduced and the leakage is minimized. As a result, it is possible to supply external cooling and lubricating fluid to the motor at a pressure in excess of the vapor pressure of the fluid and reduce the risk of motor fluid vaporization without inducing excess leakage into the pump. The laborious necessity of distilling the motor fluid and the pumped slurry from the discharged slurry is thereby avoided.

Because the seal arrangement accommodates a small amount of leakage, it is possible to use a radial bushing seal as opposed to the heretofore used axial face seals.

A conventional face seal is shown in FIG. 3 and includes a stationery face 130 and a rotating face 132 supported on a shaft 134 for isolating fluid at barrier pressure (between seals) on the left side of a housing 136 from process fluid pressure on the right hand side of housing 136, as viewed in FIG. 3. In order to accommodate radial vibration of the shaft 134, rotating face 132 is free to vibrate radially. Axial movement of the shaft is limited by the range of a pre-loaded coil spring 138 which axially clamps stationery face 130 into engagement with rotating face 132. Although a face seal can limit leakage to the order of only a few drops per day, face seals are mechanically complex, accommodate only limited axial movement, and are very costly. Due to the extremely precise machining required to ensure a proper seal, face seals can cost upwards of $8,000 to $10,000.

Alternatively, a radial bushing seal (see FIG. 4) requires controlled radial clearances, but is not dependent upon limited axial position of a shaft. As shown in FIG. 4, a radial bushing seal 140 is free to float radially and permits the rotating shaft 142 to freely move axially. This characteristic is desirable for a canned motor pump such that manufacturing tolerances and axial wear of the thrust bearings for the motor shaft can be easily tolerated. Radial bushing seals, in addition to permitting improved performance of the motor shaft, are simple and inexpensive. A suitable radial bushing seal can be manufactured for a cost on the order of $40. The present invention accommodates the use of the normally higher leakage prone, but more versatile, radial bushing seals by referencing the motor fluid to pump discharge pressure in a reference cavity defined between a pair of bushings.

Notably, it is a significant advantage of the present invention that leakage from the motor references pump discharge pressure without subjecting the backside of the impeller to increased thrust. Consequently, preferred axial balance of the impeller is achieved and the service life of the impeller thrust bearings is increased.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A canned motor pump comprising:

a motor housing connected to a supply of fluid;

a motor disposed within the motor housing and having an axially extending output shaft;

a pump housing abutting the motor housing and defining a pump inlet and pump outlet;

an impeller mounted on the motor output shaft in the pump housing for pumping a second fluid from the pump inlet to the pump outlet, said second fluid having a pressure which is increased from inlet pressure at said pump inlet to discharge pressure at said pump outlet;

a balance chamber between the impeller and the motor for receiving second fluid at inlet pressure to equalize thrust force acting on opposite sides of the impeller;

a seal assembly surrounding the motor output shaft and defining a reference cavity between the motor and the balance chamber; and a fluid passageway connecting the pump outlet and the reference cavity for supplying a quantity of the second fluid at discharge pressure to the reference cavity and thereby restricting leakage from the motor housing into the pump housing without subjecting the impeller to said increased discharge pressure.

2. The canned motor pump of claim 1 in which the seal assembly includes a pair of axially spaced seals surrounding the motor output shaft and defining said reference cavity therebetween.

3. The canned motor pump of claim 2 in which the axially spaced seals are radial bushing seals.

4. The canned motor pump of claim 1 in which the seal assembly and the passageway define a pressure differential between the motor and the pump sufficient to maintain a motor pressure in excess of the vapor pressure of the fluid from the supply.

5. A canned motor pump comprising:

a motor housing connected to a supply of cooling fluid;

a motor disposed within the motor housing and having an axially extending output shaft;

a pump housing abutting the motor housing and defining a pump inlet and pump outlet;

an impeller mounted on the motor output shaft in the pump housing for pumping a second fluid from the pump inlet to the pump outlet, said second fluid having a pressure which is increased from inlet pressure at said pump inlet to discharge pressure at said pump outlet;

a pair of axially spaced seals surrounding the motor output shaft and defining a reference cavity therebetween; and a fluid passageway connecting the pump outlet and the reference cavity for supplying a quantity of the second fluid at discharge pressure between the seals to restrict leakage from the motor housing into the pump housing, the seals and the passageway cooperating to define a pressure differential between the motor and the pump sufficient to maintain a motor pressure in excess of the vapor pressure of the fluid from the supply.

6. The canned motor pump of claim 5 in which the reference cavity is substantially isolated from the impeller to permit fluid in the motor housing to reference the pump discharge pressure without subjecting the pump impeller to said discharge pressure.

7. The canned motor pump of claim 5 in which the axially spaced seals are radial bushing seals.

* * * * *